US011667354B2

(12) United States Patent
Gormley

(10) Patent No.: US 11,667,354 B2
(45) Date of Patent: Jun. 6, 2023

(54) WHITEWATER BOAT STRAP

(71) Applicant: Philip Gormley, Wellesley, MA (US)

(72) Inventor: Philip Gormley, Wellesley, MA (US)

( * ) Notice: Subject to any disclaimer, the term of this patent is extended or adjusted under 35 U.S.C. 154(b) by 284 days.

(21) Appl. No.: 17/195,523

(22) Filed: Mar. 8, 2021

(65) Prior Publication Data

US 2022/0281559 A1 Sep. 8, 2022

(51) Int. Cl.

| | |
|---|---|
| ***B63B 21/00*** | (2006.01) |
| ***B63B 7/08*** | (2020.01) |
| ***B63B 21/04*** | (2006.01) |
| ***B63B 21/08*** | (2006.01) |

(52) U.S. Cl.

CPC ..... *B63B 21/00* (2013.01); *B63B 7/082* (2013.01); *B63B 7/085* (2013.01); *B63B 21/04* (2013.01); *B63B 21/08* (2013.01)

(58) Field of Classification Search

CPC ..... B63B 21/00; B63B 21/04; B63B 21/08; B63B 7/082; A62B 35/00; B60P 7/0823; B60P 7/0838

See application file for complete search history.

(56) References Cited

U.S. PATENT DOCUMENTS 1,038,676 A * 9/1912 Steven ..... B63B 21/56 114/250
1,259,860 A * 3/1918 Haussler ..... B63B 3/08 114/77 R
7,849,568 B2 * 12/2010 Wilkinson ..... H02G 3/30 24/298
9,855,055 B2 * 1/2018 Kosiorek ..... A61B 17/1322
10,259,375 B2 * 4/2019 Young ..... B60P 7/0823
10,349,705 B2 * 7/2019 Daniel ..... A01K 27/003
2021/0179231 A1 * 6/2021 Pimental ..... B60P 7/0823

OTHER PUBLICATIONS

Nite Ize. 2021. Dual CamJam® 1" Webbing Tensioner. [online] Available at: <https://www.niteize.com/product/Dual-CamJam-Webbing-Tensioner.asp> [Accessed Feb. 6, 2021].

(Continued)

*Primary Examiner* — Ajay Vasudeva
(74) *Attorney, Agent, or Firm* — Richard A. Baker, Jr.

(57) ABSTRACT

A boat strap is described herein, as well as a system and method of attaching two boats with the boat strap. The boat strap is made up of a main strap, a free cam, a lower cam strap, and a lower cam. The free cam is mechanically connected to the main strap, where the main strap loops through a free cam strap connector. Additional stitching connects the main strap to itself forming a free cam loop to connect the free cam to the main strap. The lower cam is mechanically connected to the lower cam strap. The lower cam strap loops through a lower cam strap connector, and a primary stitching connects the lower cam strap to itself forming a lower cam loop to connect the lower cam to the lower cam strap, wherein the primary stitching further connects the lower cam strap to the main strap. The main strap loops through a connector on one boat and runs through the lower cam to attach the boat strap to the rail. The main strap then is run through the cam on a second boat strap on the other boat, attaching the boats.

11 Claims, 5 Drawing Sheets

(56) References Cited

OTHER PUBLICATIONS

Amazon.com. 2021. Nite Ize Dual CamJam Tie Down Strap System, Proprietary Dual Cam Zinc Alloy Buckle + High Strength Nylon Strap, 400LB Load Limit, 18FT Webbing, [online] Available at: <https://www.amazon.com/Nite-Ize-CJD18-09-R3-CamJam-System/dp/B01NBN6K1W/ref=sr_1_3?dchild=1&keywords=dual%2Bcam%2Bstraps&qid=1612623186&sr=8-3&th=1> [Accessed Feb. 6, 2021].

Height Dynamics. 2021. 3M DBI-SALA Rope Pols Strap with Stainless Connectors, [online] Available at <https://shop.heightdynamics.com.au/collections/work-positioning-lanyards/products/rope-pole-strap-stainless-carabiners> [Accessed Feb. 13, 2021].

EcoEquipment. 2021. Dunamis Full-Body Harness with Double Webbing-Lanyard, [online] Available at <https://www.ecoequipment.net/product/full-body-harness-with-double-lanyard-and-back-support/> [Accessed Feb. 13, 2021].

WinTech Racing. 2021. Boat Strap. [online] Available at <https://store.wintechracing.com/products/boat-strap> [Accessed Feb. 13, 2021].

OontZ. 2021. OontZ Bluetooth Speaker Mounting Strap. [online] Available at <https://www.theoontz.com/oontz-bluetooth-speaker-mounting-strap> [Accessed Feb. 13, 2021].

* cited by examiner

WHITEWATER BOAT STRAP

CROSS-REFERENCE TO RELATED APPLICATIONS

This is a priority patent application.

BACKGROUND

Technical Field

The present inventions relate to the field of strapping. More specifically, the present inventions relate to the field of strapping systems for boats.

Description of the Related Art

A trip of 15 people on a trip down the Colorado River through the Grand Canyon may have 5 large "row-frame rafts" designed to carry lots of gear and people. These rafts are 18 feet long and each weigh 2,000 to 3,000 pounds when fully loaded.

Straps are needed to assist with managing the five large rafts when they need to be attached together—either to create a flotilla or, more importantly, to quickly link boats when they need to be secured to shore. Trips may frequently pull off to the side of the river so the rafters can run down and "scout" a rapid they are about to navigate. The places they pull the rafts off to scout are commonly steep, narrow, and otherwise challenging spots to secure boats. Sometimes the boats are pulled into a "surging eddy" that tosses boats around and further complicates tying off.

Traditionally, each boat captain, "boatman," is responsible for improvising a method of securing her/his boat. Each raft has a 50-foot line on both the bow and stern that is used for this purpose. It is important to secure each boat with two independent attachments to two independent attachment points. Boatmen usually tie off to shore with a bow or stern line and attach in some other manner to an adjoining boat. An improperly secured boat is in danger of floating off on its own—often immediately running a rapid significant enough to require a scout.

An improved method of attaching multiple rafts together is needed to assure that the boats are securely attached. The present set of inventions describe whitewater boat strap apparatus for rapidly and securely attaching two rafts together.

SUMMARY OF THE INVENTIONS

A boat strap is described herein. The boat strap is made up of a main strap, a free cam, a lower cam strap, and a lower cam. The free cam is mechanically connected to the main strap, where the main strap loops through a free cam strap connector. Additional stitching connects the main strap to itself forming a free cam loop to connect the free cam to the main strap. The lower cam is mechanically connected to the lower cam strap. The lower cam strap loops through a lower cam strap connector. A primary stitching connects the lower cam strap to itself forming a lower cam loop to connect the lower cam to the lower cam strap, wherein the primary stitching further connects the lower cam strap to the main strap.

In some embodiments, the additional stitching is incorporated into the primary stitching. The tail of the main strap could have a 45-degree angle. The lower cam could face the main strap or it could face away from the main strap. The main strap could loop around the side frame rail and the main strap could be threaded through the lower cam. The side frame rail could be attached to a boat.

A system for attaching a first boat to a second boat with a first boat strap and a second boat strap is described here. The system is made up of the first boat with a first frame that includes a first side frame rail. The first boat strap is attached to the first side frame rail. The second boat has a second frame that includes a second side frame rail. The second boat strap is attached to the second side frame rail. The first boat is connected to the second boat through a connection between the first boat strap and the second boat strap. The first boat strap is made up of a first main strap, a first free cam, a first lower cam strap, and a first lower cam. The first free cam is mechanically connected to the first main strap. The first main strap loops through a first free cam strap connector. The first additional stitching connects the first main strap to itself forming a first free cam loop to connect the first free cam to the first main strap. The first lower cam is mechanically connected to the first lower cam strap. The first lower cam strap loops through a first lower cam strap connector, and a first primary stitching connects the first lower cam strap to itself forming a first lower cam loop to connect the first lower cam to the first lower cam strap. The first primary stitching further connects the first lower cam strap to the first main strap.

The second boat strap is made up of a second main strap, a second free cam, a second lower cam strap, and a second lower cam. The second free cam is mechanically connected to the second main strap. The second main strap loops through a second free cam strap connector, and an second additional stitching connects the second main strap to itself forming a second free cam loop to connect the second free cam to the second main strap. The second lower cam is mechanically connected to the second lower cam strap. The second lower cam strap loops through a second lower cam strap connector, and a second primary stitching connects the second lower cam strap to itself forming a second lower cam loop to connect the second lower cam to the second lower cam strap. The second primary stitching further connects the second lower cam strap to the second main strap.

The first main strap is threaded through the second free cam.

The second main strap could be threaded through the first free cam. The first boat could be a whitewater raft. The second boat could be a whitewater raft. The first additional stitching and the first primary stitching could be the same. The tail of the first main strap could have a 45-degree angle. The cam tab on the first lower cam could face the first main strap or it could face away from the first lower cam.

A method of connecting a first boat to a second boat is described here. The method includes the steps of (1) attaching a first boat strap to a first connection point on a first boat, securing the first boat strap to the first connection point; (2) attaching a second boat strap to a second connection point on a second boat, securing the second boat strap to the second connection point; and (3) inserting the first boat strap in the second free cam. The first boat strap is made of a first main strap, a first free cam mechanically connected to the first main strap, a first lower cam strap, and a first lower cam mechanically connected to the first lower cam strap, wherein a first primary stitching connects the first lower cam strap to the first main strap, wherein the first main strap loops around the first connection point through the first lower cam. The second boat strap is made of a second main strap, a second free cam mechanically connected to the second main strap, a second lower cam strap, and a second lower cam mechanically connected to the second lower cam strap, wherein a second primary stitching connects the second lower cam strap to the second main strap, wherein the second main strap loops around the second connection point through the second lower cam.

The method could further include the step of (4) inserting the second boat strap in the first free cam. The first connection point could be a side frame rail of the first boat or a ring attached to the boat of a roof rack.

DETAILED DESCRIPTION OF THE INVENTIONS

Figure 1:
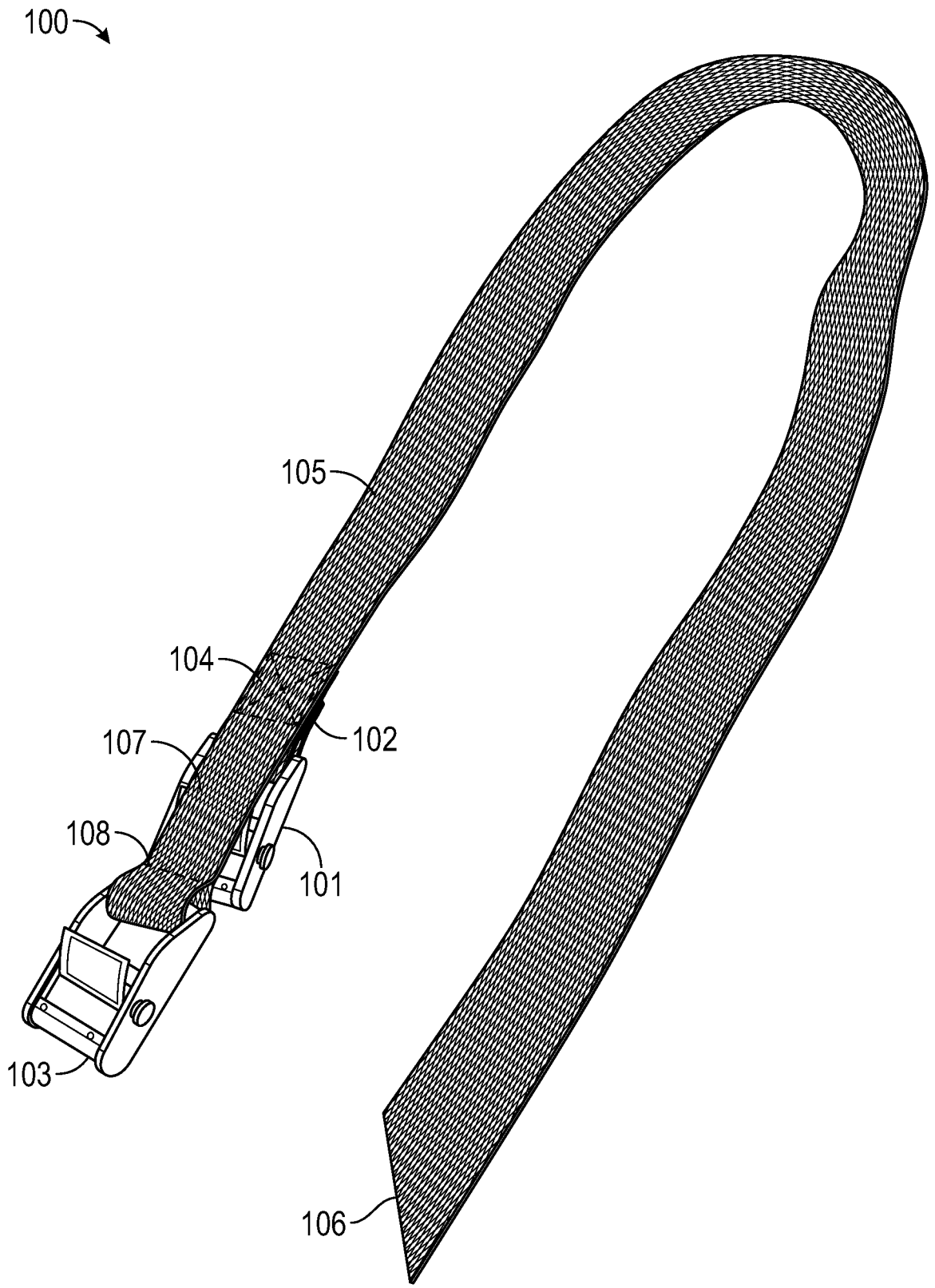
FIG. 1 shows the whitewater boat strap with the two cams.

Note that the specific embodiments given in the drawings and the following description do not limit the disclosure. On the contrary, they provide the foundation for one of ordinary skill to discern the alternative forms, equivalents, and modifications that are contemplated by the inventors and encompassed in the claim scope.

The free end of the strap 106 is called the "tail." Metal pieces are called "cams" 101,103. The lower cam 101 is used to attach the strap to a raft frame and the free cam 103 is left free so it can be used to quickly link/unlink to the tail 106 of another adjoining raft 400.

Straps 100 are attached to the middle of the frame on each side of a raft 400. They are attached so that both the free cam 103 and tail 106 dangle off each side to enable quick linking/unlinking of rafts 400 to each other.

The whitewater boat straps 100 greatly simplify the tie-off process and improve the security of the entire set of boats 400. When a couple of boats 400 are side-by-side the free cam 103 of one boat 400 can be attached to the tail 106 of the other boat 400. In this manner, all of the boats 400 in a flotilla can be attached together quickly and easily. Once rafts 400 are attached side-to-side the entire flotilla can be tied off to shore with two or more bow or stem lines.

Note: each boat 400 has both a free cam 103 and free tail 106 on each side potentially allowing a double attachment: cam 103 of one boat 400 to the tail 106 of the adjoining boat 400 and vice versa.

Being able to link a set of rafts 400 in this manner is safer and easier than having to improvise attachments. Once all rafts 400 are linked together the large pod of rafts can easily be tied off to a tree or pile of rocks onshore using 2 separate lines and attachment points.

Turning to FIG. 1, the whitewater raft strap 100 is seen. The strap 100 consists of two cams 101, 103 mechanically attached to a main strap 105. The main strap 105 could be made of 1-inch wide high-tenacity (over 1,500 lbs) UV treated polypropylene, in one embodiment. Other widths could be used. The main strap 105 could also be made of leather, nylon, linen, cotton, wool, felt, canvass, polyester, polypropylene, Biothane, Dacron, acrylic, vinyl, paracord, plastic, elastic, rubber, carbon fiber, etc and various combinations thereof. Main strap 105 could be a single layer or a plurality of layers of the same or a different material. Main strap 105 could be round, hollow, or flat. Main strap 105 could be treated with stiffeners, UV, fire, repellency, and/or mildew protection.

One end of the main strap 105 is the tail 106. The tail 106 is cut at a 45-degree angle in some embodiments, although other angles could be used. The tail 106 could be any length. In one embodiment, the tail 106 is 2-3 feet beyond the primary stitching 104.

The other end of the main strap 105 is connected to the strap connector 306 by looping the main strap 105 through the strap connector 306 and connecting the main strap 105 to itself with additional stitching 108 close to the strap connector 306 and with the primary stitching 104 at the end of the strap 106. The primary stitching could be in the form of an X in a box as seen in FIG. 1, or any other stitching design. In other embodiments, different stitching 104,108 schemes could be used without deviating from the inventions herein. For instance, additional stitching 108 could be the X in the box shape. The end of the main strap 105 could extend no further than the additional stitching 108, in some embodiments.

The lower cam 101 is connected to the main strap 105 with the lower cam strap 102. The lower cam strap 102 loops through the strap connector 306 of the lower cam 101. Both ends of the lower cam strap 102 are attached to the main strap 105 with the primary stitching 104. In some embodiments, the lower cam strap 102 has additional stitching. The lower cam strap 102 is made of the same material as the main strap 105 in some embodiments. In other embodiments, the lower cam strap could be made of any of the other strap materials described above.

In some embodiments, the cam tab 302 for the lower cam 101 faces into the main strap 105. The free cam 103 may have the same orientation. In other embodiments, the cams 101,103 may have different orientations.

The main strap 105 has a free overhang distance 107. This is the distance between the free cam 103 and the primary stitching 104. The free overhang distance 107 is the distance that the free cam 103 can hang from the boat frame 402.

Figure 2:
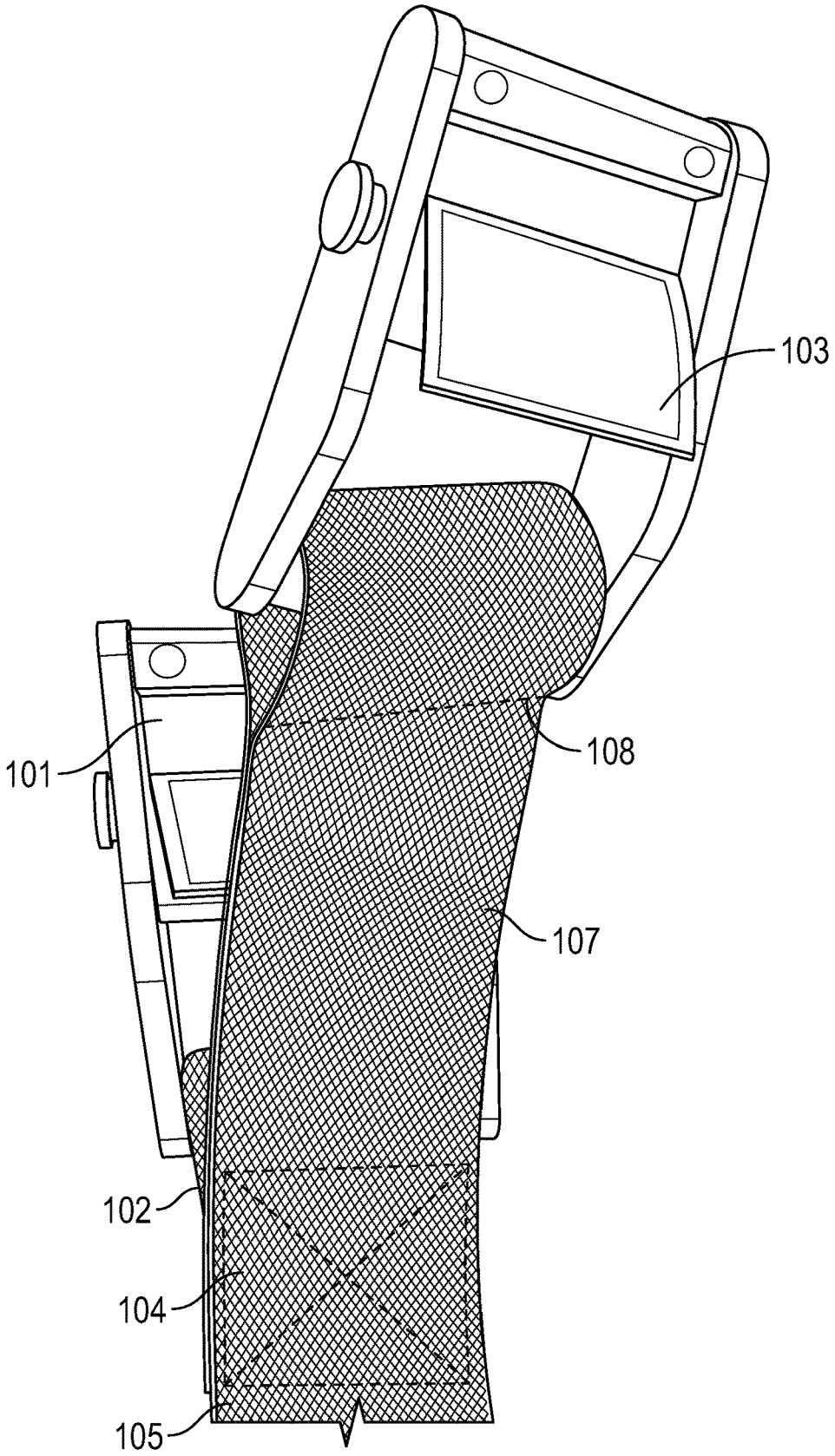
FIG. 2 shows a close-up view of the whitewater boat strap with a focus on the two cams.

FIG. 2 shows the orientation of the two cams 101,103 in further detail, for one embodiment. The main strap 105 loops up through the free cam 103 and back down to the primary stitching 104 for the free overhang distance 107. The strap may also include additional stitching 108 near the free cam 103. The lower cam strap 102 is attached to the main strap 105 with the primary stitching 104. The lower cam strap 102 loops through the lower cam 101, connecting the lower cam 101 to the main strap 105.

Figure 3:
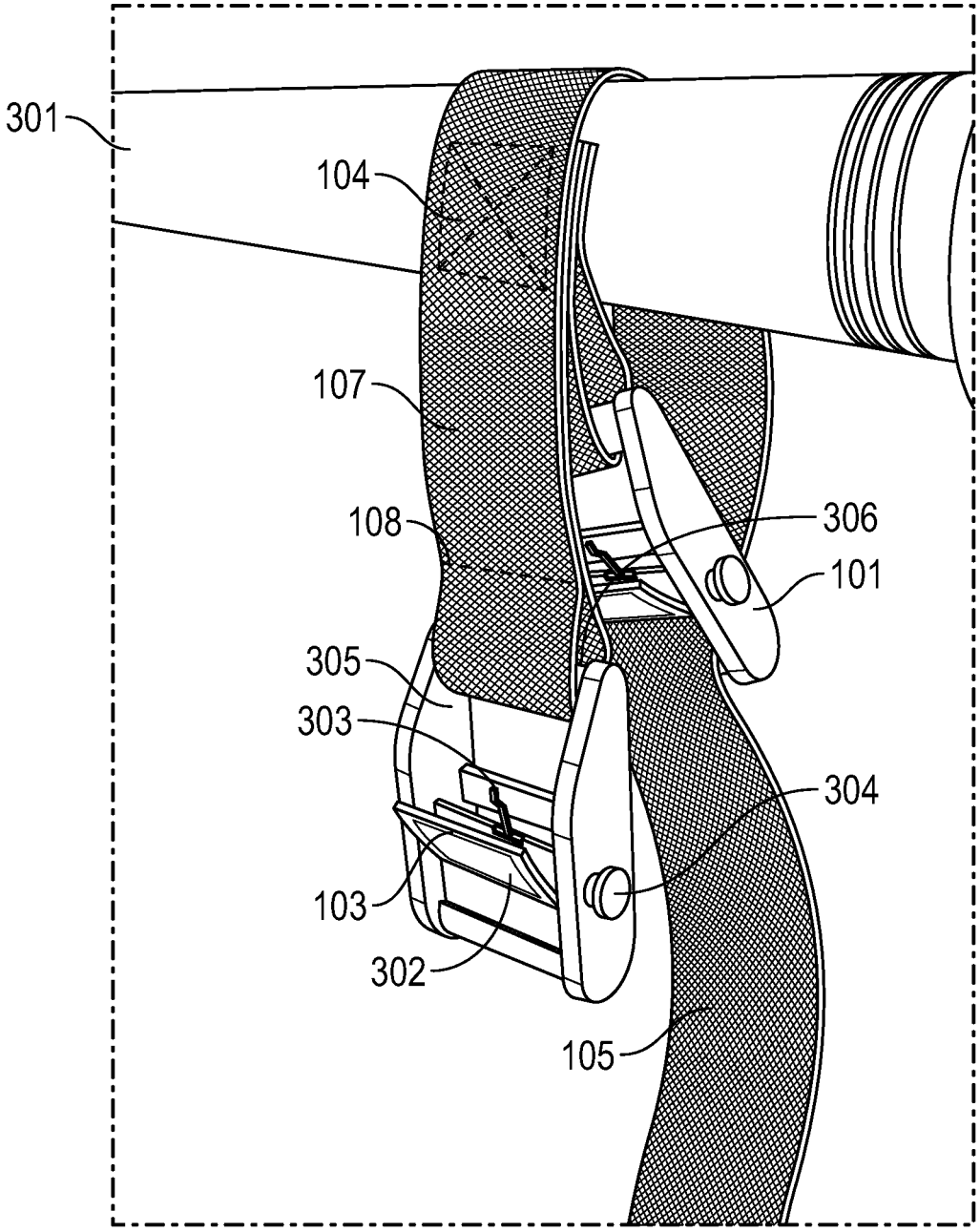
FIG. 3 shows the whitewater boat strap connected to a boat frame.

Looking to FIG. 3, the installed whitewater boat strap 100 is seen attached to a side frame rail 301. The main strap 105 loops over the side frame rail 301 and threads through the lower cam 101. The lower cam 101 can then be adjusted to hold the whitewater boat strap 100 tight to the side frame rail 301. The free cam 103 hangs free the free overhang distance 107 from the side frame rail 301.

When used to connect two boats, the tail 106 of the main strap 105 is sent through the free cam 103 on the other boat 400, connecting the boats. For further security, the straps 105 on both boats 400 could be connected to the free cams 103 on the other boat 400.

FIG. 3 also shows the components of the cams 101, 103. The cams 101,103 could be made of the same material in some embodiments. The material could be brass, bronze, copper, ceramic, iron, magnesium, nickel, steel, silver, gold, white metal, aluminum, plastic, acrylonitrile butadiene styrene (ABS), nylon, polyvinyl chloride (PVC), polypropylene (PP), polycarbonate (PC), acrylic, acetal, etc. or any combination thereof.

The cams 101,103 are comprised of a cam frame 305 that includes a strap connector 306 at one end. The cam frame 305 has two holes to hold the cam pin 304. The cam pin 304 holds the cam tab 302 and the cam spring 303. The cam spring 303 pushes the cam tab 302 against the cam frame 305, maintaining pressure to hold the main strap 105 in place. When the cam tab 302 is pressed, the tab 302 swings back away from the cam frame 305, releasing the main strap 105, allow the main strap 105 to move freely, and to be removed if desired.

Figure 4:
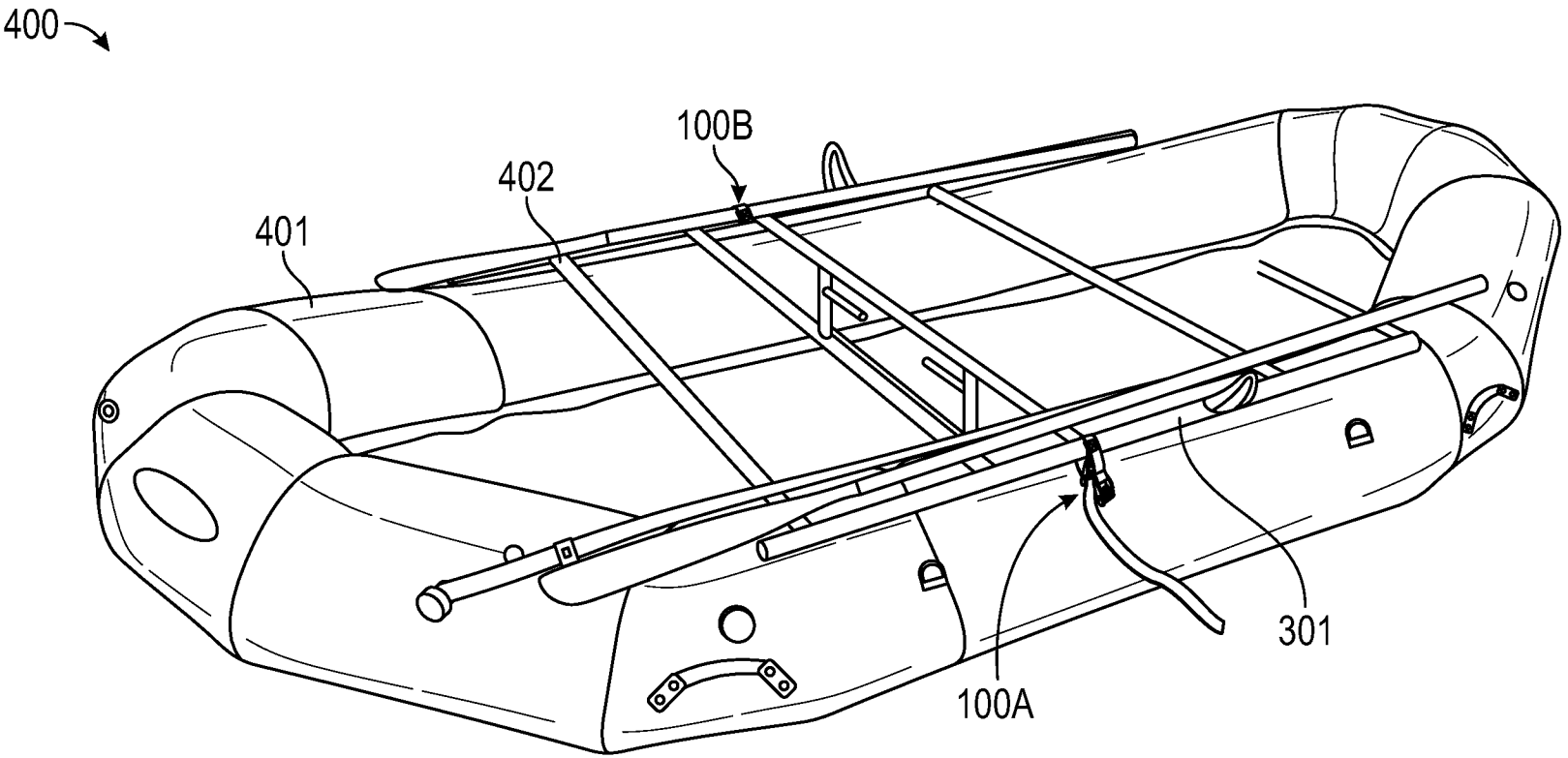
FIG. 4 shows a whitewater raft with two straps connected to each side of the raft frame.

FIG. 4 shows the whitewater boat straps 100A, 100B installed on the boat 400. The boat 400 has a hull 401 and a frame 402. The frame 402 has a boat side rail 301 on each side. Each boat side rail 301 has a whitewater boat strap 100A, 100B installed on the frame 402. When connecting two boats, one whitewater boat strap 100A one a first boat is connected to the whitewater boat strap 100B on the other boat. Since the whitewater boat straps 100A,100B are identical, the direction of the boat 400 is not important, and the boats 400 can be connected if they are both in the same direction or not.

Figure 5:
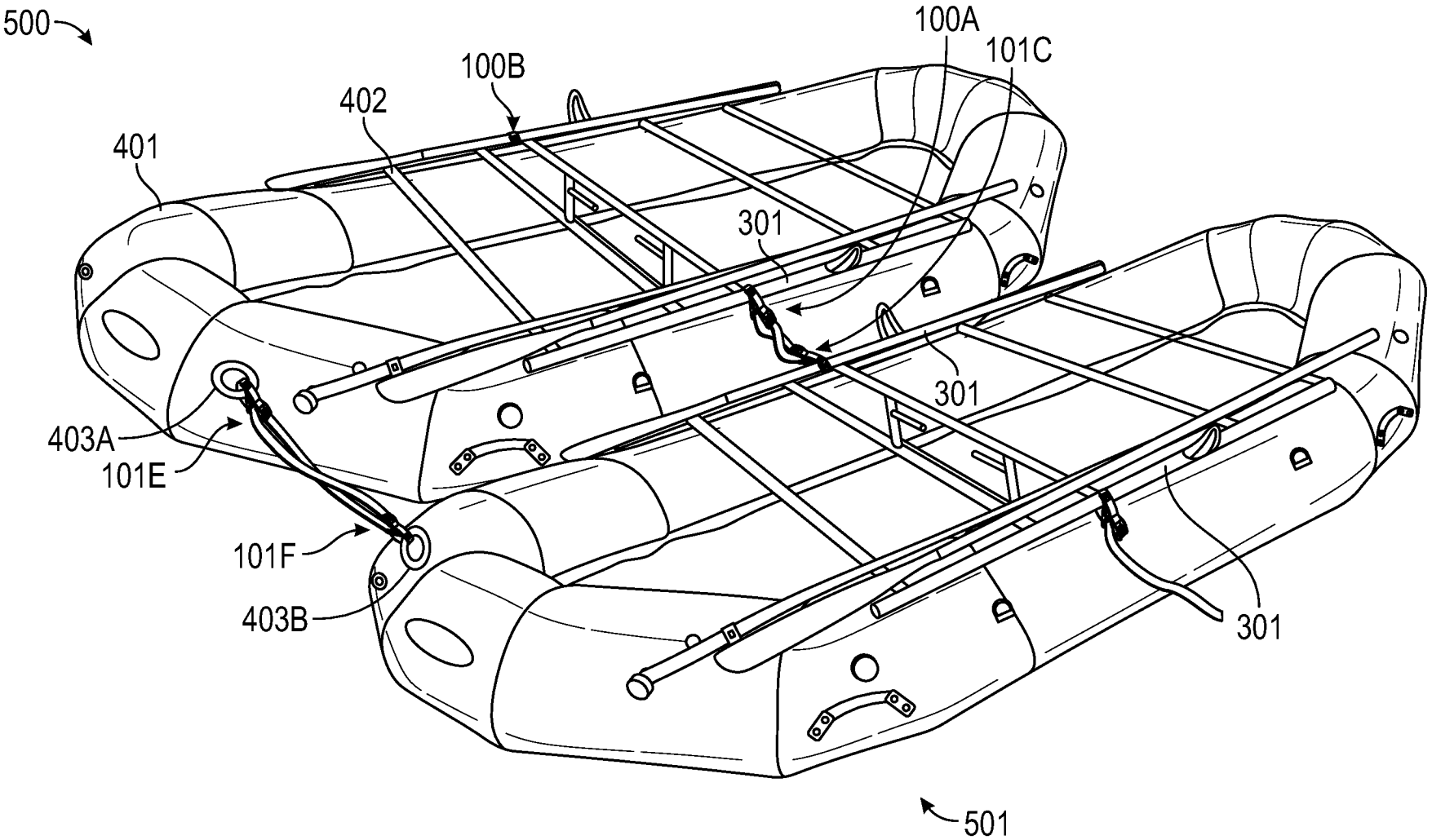
FIG. 5 shows two whitewater rafts with four straps attaching the two rafts.

FIG. 5 shows two whitewater boats 500,501 attached with four whitewater boat straps 100A,100C, 101E,101F. Whitewater boat straps 101E,101F are attached to boats 500,501 through rings 403A,403B.

While the above description discusses the use of the whitewater boat strap 100 attaching whitewater rafts 400, the whitewater boat strap 100 could be used to attach other types of boats or in other strapping situations. For instance, it could be used to strap a kayak to the roof rack rails of a car. Or it could be used to lash a lowered sail to the boom on a sailboat. In other embodiments, the boat could have a ring screwed into or molded into the deck of the boat. Any other similar types of connection points are envisioned.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A system for attaching a first boat to a second boat with a first boat strap and a second boat strap comprising:

the first boat with a first frame that comprises a first side frame rail, the first boat strap attached to the first side frame rail; and the second boat with a second frame that comprises a second side frame rail, the second boat strap attached to the second side frame rail, wherein the first boat is connected to the second boat through a connection between the first boat strap and the second boat strap;

wherein the first boat strap comprises:

a first main strap;

a first free cam mechanically connected to the first main strap, wherein the first main strap loops through a first free cam strap connector, and a first additional stitching connects the first main strap to itself forming a first free cam loop to connect the first free cam to the first main strap;

a first lower cam strap; and a first lower cam mechanically connected to the first lower cam strap, wherein the first lower cam strap loops through a first lower cam strap connector, and a first primary stitching connects the first lower cam strap to itself forming a first lower cam loop to connect the first lower cam to the first lower cam strap, wherein the first primary stitching further connects the first lower cam strap to the first main strap;

wherein the second boat strap comprises:

a second main strap;

a second free cam mechanically connected to the second main strap, wherein the second main strap loops through a second free cam strap connector, and a second additional stitching connects the second main strap to itself forming a second free cam loop to connect the second free cam to the second main strap;

a second lower cam strap; and a second lower cam mechanically connected to the second lower cam strap, wherein the second lower cam strap loops through a second lower cam strap connector, and a second primary stitching connects the second lower cam strap to itself forming a second lower cam loop to connect the second lower cam to the second lower cam strap, wherein the second primary stitching further connects the second lower cam strap to the second main strap;

wherein the first main strap is threaded through the second free cam.

2. The system of claim 1 wherein the second main strap is threaded through the first free cam.

3. The system of claim 1 wherein the first boat is a whitewater raft.

4. The system of claim 3 wherein the second boat is a whitewater raft.

5. The system of claim 1 wherein a tail of the first main strap has a 45-degree angle across a width of the strap.

6. The system of claim 1 wherein a cam tab on the first lower cam faces the first main strap.

7. The system of claim 1 wherein a cam tab on the first free cam faces away from the first lower cam.

8. A method of connecting a first boat to a second boat comprising:

attaching a first boat strap to a first connection point on the first boat, wherein the first boat strap comprises a first main strap, a first free cam mechanically connected to the first main strap, a first lower cam strap, and a first lower cam mechanically connected to the first lower cam strap, wherein a first primary stitching connects the first lower cam strap to the first main strap, wherein the first main strap loops around the first connection point through the first lower cam, securing the first boat strap to the first connection point;

attaching a second boat strap to a second connection point on the second boat, wherein the second boat strap comprises a second main strap, a second free cam mechanically connected to the second main strap, a second lower cam strap, and a second lower cam mechanically connected to the second lower cam strap, wherein a second primary stitching connects the second lower cam strap to the second main strap, wherein the second main strap loops around the second connection point through the second lower cam, securing the second boat strap to the second connection point; and inserting the first boat strap in the second free cam.

9. The method of claim 8 further comprising inserting the second boat strap in the first free cam.

10. The method of claim 8 wherein the first connection point is a side frame rail of the first boat.

11. The method of claim 8 wherein the first connection point is a ring attached to the boat.

* * * * *